US006580043B1

(12) United States Patent
Spratte

(10) Patent No.: US 6,580,043 B1
(45) Date of Patent: Jun. 17, 2003

(54) CONTACT ELEMENT FOR AN ELECTRICAL DEVICE

(75) Inventor: Joachim Spratte, Osnabrück (DE)

(73) Assignee: Mannesmann VDO AG, Frankfurt am Main (DE)

( * ) Notice: Subject to any disclaimer, the term of this patent is extended or adjusted under 35 U.S.C. 154(b) by 0 days.

(21) Appl. No.: 09/898,188

(22) Filed: Jul. 3, 2001

(30) Foreign Application Priority Data

Jul. 18, 2000 (DE) ..... 100 34 771

(51) Int. Cl.[7] ..... H01H 1/10
(52) U.S. Cl. ..... 200/517; 200/512; 200/313
(58) Field of Search ..... 200/511, 512, 200/513, 304, 313, 314, 517, 310, 317, 311, 341

(56) References Cited

U.S. PATENT DOCUMENTS 4,343,975 A * 8/1982 Sado ..... 200/314
5,655,826 A * 8/1997 Kouno et al. ..... 362/24
5,661,279 A * 8/1997 Kenmochi ..... 200/314
5,664,667 A * 9/1997 Kenmochi ..... 200/314
5,924,555 A * 7/1999 Sadamori et al. ..... 200/512
5,975,711 A * 11/1999 Parker et al. ..... 362/24
5,986,228 A * 11/1999 Okaamoto et al. ..... 200/516
6,044,152 A 3/2000 Mendolia ..... 379/433
6,198,060 B1 * 3/2001 Yamazaki et al. ..... 200/305
6,310,308 B1 * 10/2001 Watson et al. ..... 200/520

FOREIGN PATENT DOCUMENTS

DE 37 33 002 A1 9/1987 ..... H05K/3/18
DE 44 42 073 A1 11/1994 ..... H01H/13/70

OTHER PUBLICATIONS

Mair, H.J., Roth, S.: Elektrisch leitende Kunststoffe, Carl Hanser Verlag, München, Wien, 1986, ISBN 3–446–14608–3, S.94–99, 143–147.

* cited by examiner

*Primary Examiner*—Elvin Enad
*Assistant Examiner*—K. Lee
(74) *Attorney, Agent, or Firm*—Richard A. Speer; Mayer, Brown, Rowe & Maw

(57) ABSTRACT

A contact element (1) for an electrical device has an electrically conductive coating (11) deposited on a switching mat (7), whereby electrostatic discharge transmitted to a key (2) will be deflected by the electrically conductive coating (11) into the casing (3) of the electrical device.

4 Claims, 2 Drawing Sheets

CONTACT ELEMENT FOR AN ELECTRICAL DEVICE

BACKGROUND OF THE INVENTION

Subject of the invention is a contact element for an electrical device comprised of a sliding key to be pressed down, with a flexible switching mat delimiting an area with electrical contacts at specific distances, and with an element protecting against electrostatic discharge designed to be connected to a ground terminal of the electrical device.

Such contact element is used especially often in keyboards for computers or consumer electronics equipment, and is known from practical applications. The protective element is usually designed as a metal plate located above the switching mat with a recess for the key. The user can generate electrostatic voltages of up to 25 kV, which are routed via the metal plate into the ground of the electrical device, preventing the electronic components of the electrical device from being damaged.

The disadvantage of the known contact element is that the metal plate is costly to manufacture and difficult to install.

The objective of this invention is to design a contact element of the aforementioned type, which can be manufactured in a highly economical manner.

BRIEF DESCRIPTION OF THE INVENTION

The invention solves this problem with the specific characteristic that the protective element has an electrically conductive coating on the side of the mat facing the key.

The installation of the protective element on the switching mat automatically establishes protection against electrostatic discharge while the switching mat is being assembled. This makes a separate installation of the protective element unnecessary. Furthermore in comparison, depositing the coating during the manufacture of the switching mat can be done in a much more economical manner than the installation of the metal plate. This makes the contact element as introduced in this invention especially economical. Another advantage of the invention is that the protective element requires less installation space.

The manufacturing costs for the contact element described in this invention can be reduced further if the electrically conductive coating contains conductive lacquer or electrographic ink. Such conductive lacquer or electrographic ink is often used as contact within the switching mats, and contains particles with a specific electrical conductivity like, for example, graphite.

The electrically conductive coating could, for example, like the metal plate for the known protective element, have a very low impedance.

However, as a result, the user of the contact element described in this invention would receive a perceptible electric shock when the static electricity is being discharged. This is for the user perceptible shock can be avoided with an advanced design of the invention, namely, when the electrically conductive coating has a high impedance relative to metal.

Using another advanced design of the invention, the electrostatic discharge can be deflected especially reliably, if at least part of the key is coated with an electrically conductive coating.

DESCRIPTION OF THE DRAWINGS

The invention permits various design options. In order to clarify the basic principle, two of these options have been illustrated in the figures, and are described below.

DETAILED DESCRIPTION OF THE INVENTION

Figure 1:
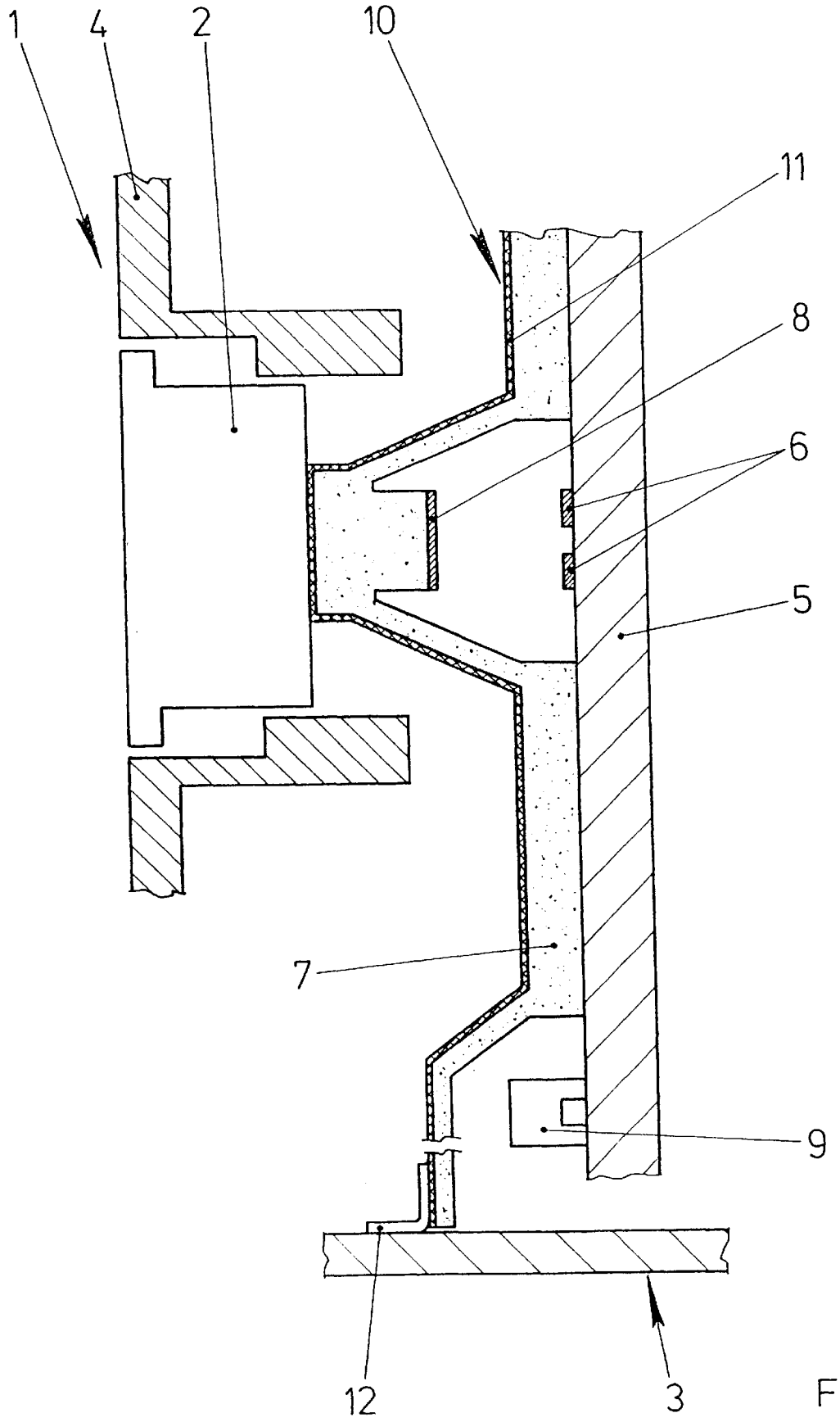
FIG. 1 is a cross-sectional view of a contact element as described in this invention.

FIG. 1 shows a contact element 1 with a sliding key 2 within a bezel 4. The contact element 1 represents only one of many contact elements installed next to each other in a keyboard for a computer or consumer electronics device. To simplify the drawing, the grounded casing 3 of the keyboard or the consumer electronics device is partially shown as a panel. The contact element 1 has a bezel 4 and a printed circuit board 5 installed at a distance from the bezel 4. Installed on the printed circuit board 5 are electrical contacts 6 and a switching mat 7 with another electrical contact 8.

The contacts 8 of the switching mat 7 and the printed circuit board 5 are located opposite to each other. The switching mat 7 is made of rubber-type flexible material, and pretensioned in the position shown in the figure, with contacts 6 and 8 at a distance from each other. This ensures that key 2 is being held in the position shown in the figure.

When key 2 is pressed down, the switching mat 7 changes its shape and its contact 8 is moved toward the contacts 6 on the printed circuit board 5. Also located on the printed circuit board 5 are the electronic components 9, which monitor the bridging of contacts 6, 8, and generate an electronic signal. The electronic components 9 are also located beneath the switching mat 7. On the side of switching mat 7 that faces key 2 there is a protective element 10 with an electrically conductive coating 11. The electrically conductive coating 11 may be conductive lacquer or electrographic ink as is the case for the electrical contact 8 on the switching mat 7. A metal element 12 is used to connect the electrically conductive coating 11 to the housing 3. Any electrostatic charge being discharged by touching key 2 reaches the electrically conductive coating 11 and is deflected from there into the housing 3.

Figure 2:
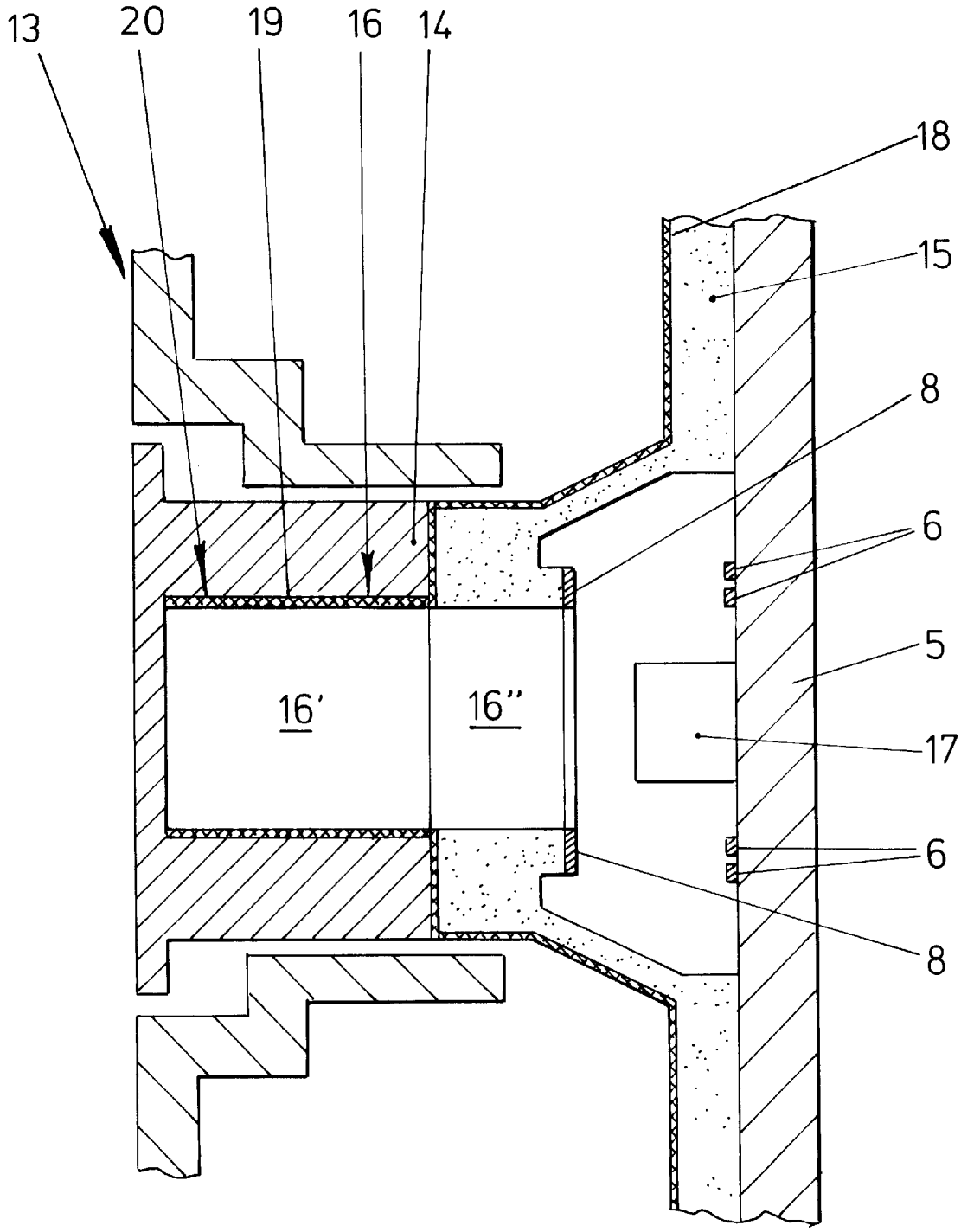
FIG. 2 is a cross-sectional view of a lighted contact element as described in this invention.

FIG. 2 shows a contact element 13, where a key 14 and a switching mat 15 exhibit a recess 16. Recess 16 contains a light source 17 in the form of an LED. Key 14 can therefore be lit. The switching mat 15 has an electrically conductive coating 18. A section of key 14 does also have an electrically conductive coating 19. Together, the electrically conductive coatings form a protective element 20 for the discharge of electrostatic charges. An electrostatic discharge will be effected in the same manner as shown in FIG. 1. Otherwise, the contact element 13 is designed for the most part as the one in FIG. 1.

It is also possible for the key to be made from an electrically conductive material or to be painted with an electrically conductive material. A direct electrical connection between this conductive material and the switching mat is not required, if the gap between the switching mat and the conductive material is sufficiently small.

What is claimed is:

1. Contact element for an electrical device, including a circuit board having light sources mounted thereon, the contact element comprising:

(1) an electrically conductive sliding key having a cavity extending inwardly from one side thereof;

(2) a flexible switching mat delimiting an area with electrical contacts at specific distances, the mat having an opening extending there through in registry with the sliding key cavity, wherein the key cavity and the opening in the mat together define a recess for receiving a circuit board mounted light source.

2. Contact element as defined in claim 1, wherein an electrically conductive coating containing conductive lacquer or electrographic inc is located on the switching mat facing the sliding key.

3. Contact element as defined in claim 1, wherein the key has at least a partial area coated with an electrically conductive coating.

4. A contact element as defined in claim 1 wherein the switching key is made from an electrically conductive material.

* * * * *